US006471570B1

(12) United States Patent
Minami et al.

(10) Patent No.: US 6,471,570 B1
(45) Date of Patent: Oct. 29, 2002

(54) END SURFACE POLISHING MACHINE

(75) Inventors: Kouji Minami, Chiba (JP); Kizaburo Yoshida, Narashino (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/546,771

(22) Filed: Apr. 11, 2000

(30) Foreign Application Priority Data

Apr. 12, 1999 (JP) ..... 11-104569

(51) Int. Cl.[7] ..... B24B 7/22
(52) U.S. Cl. ..... 451/271; 451/41
(58) Field of Search ..... 451/271, 270, 451/41

(56) References Cited

U.S. PATENT DOCUMENTS 2,275,061 A * 3/1942 Indge ..... 451/271
2,320,376 A * 6/1943 Mueller ..... 451/271
3,172,241 A * 3/1965 Habenicht ..... 451/271
4,726,150 A * 2/1988 Nishio et al. ..... 451/271
5,516,328 A * 5/1996 Kawada ..... 451/271
5,791,976 A * 8/1998 Honda ..... 451/271

* cited by examiner

*Primary Examiner*—Robert A. Rose
(74) *Attorney, Agent, or Firm*—Adams & Wilks

(57) ABSTRACT

An end surface polishing drive mechanism has a first rotational shaft mounted for undergoing rotation about a first axis and for undergoing revolving movement about a second axis. The first rotational shaft has a first end for connection to a polishing device to undergo rotation therewith and a second end. A second rotational shaft undergoes rotation about the second axis. A drive mechanism produces a driving force to rotationally drive the first and second rotational shafts and to revolve the first rotational shaft. A first gear is connected to the first rotational shaft for undergoing rotation and revolving movement therewith. A second gear is rotatably mounted on the second rotational shaft and is connected to the first gear for transmitting a drive force of the drive means to the first rotational shaft.

37 Claims, 7 Drawing Sheets

FIG. 4A
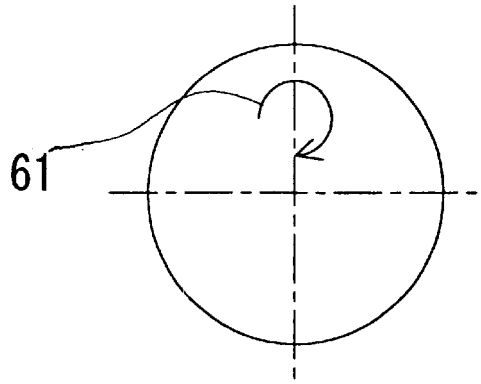
FIG. 4B
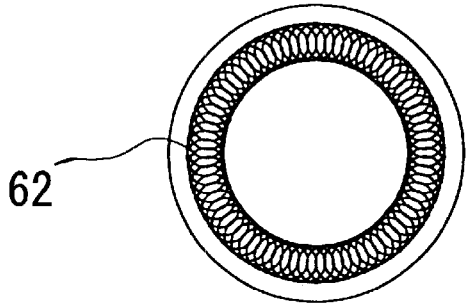
FIG. 4C
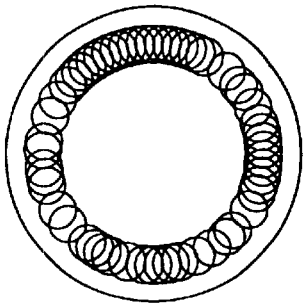
FIG. 4D
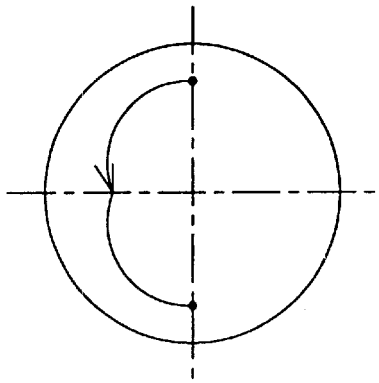
FIGs. 4

END SURFACE POLISHING MACHINE

BACKGROUND OF THE INVENTION

The present invention relates to an end surface polishing drive mechanism and to an end surface polishing machine having the drive mechanism for polishing the end surfaces of rod-shaped members such as an optical communications fiber elements.

Fiber elements (hereinafter "fiber") are used in optical communication and are fixed in ferrules. The end surface of a ferrule and the end surface of a fiber are simultaneously polished so as to be smoothed into a mirrored finish after the fiber is adhered within a central hole of the ferrule that constitutes the main part of a connector. However, if the polished surfaces of the ferrule and the fiber are not perpendicular to a central axis of the ferrule, or if any of the polished surfaces are blemished in some manner, the precision of positioning opposing ferrules at optical connectors for connecting opposing ferrules together deteriorates and loss is therefore substantial. It is therefore necessary to give the polished surface of the ferrule including the optical fiber a high-precision polished finish.

This type of related optical fiber end surface polishing machine is disclosed in PCT International Publication Laid-open No. WO94/09944. This end surface polishing machine is provided with a fixing jig for fixing a plurality of ferrules to which optical fibers are fixed, The fixing jig is supported by a support mechanism, and a polisher provided with a polishing member for polishing the ferrules is located opposite the ferrules. The polisher is driven by a lapping motion mechanism capable of rotating the polisher both orbitally and about its own axis so that the end surfaces of the plurality of ferrules make contact with the polishing member in such a manner as to be subjected to the same pressure by the polishing member, with the end surfaces of the plurality of ferrules therefore being worked into a convex spherical surface.

A specific configuration for this machine is now described with reference to FIG. 6 and FIG. 7. As shown in FIG. 6 and FIG. 7, a central part of a first axial rotation transmitter 2 is fixed to the axis of rotation of a rotation motor 1 and a plurality of first coupling pins 3 are concentrically fixed to the first axial rotation transmitter 2 taking the center of rotation as center. Each first coupling pin 3 is coupled in a freely rotatable manner to a deviating part deviating by just a prescribed amount ($e_1$) from each corresponding rotation transmitter 4, and first coupling pins 5 are fixed to the deviating part at each rotation transmitter 4. Each first coupling pin 5 is coupled in a freely rotating manner to a second axial rotation transmitter 6.

On the other hand, the central part of a driving gear 8 is fixed to a rotating shaft of an orbital rotation motor 7, and a driven gear 9 meshes with the driving gear 8. The driven gear 9 is fixed to the lower outer periphery of an orbital rotation transmission shaft 11, with a bearing 10 of a machine body fitting about the upper outer periphery of the orbital rotation transmission shaft 11. An axial rotation shaft 13 is fitted at the orbital rotation transmission shaft 11 in a freely rotatable manner at a position offset by a prescribed amount ($e_2$) from the center of rotation, with the lower end of this axial rotation shaft 13 fixed to the central part of the second axial rotation transmitter 6.

With this axial rotation, the orbital rotation motor 7 causes the orbital rotation transmission shaft 11 to revolve about a Y axis via the driving gear 8 constituted by a single gear train and the driven gear 9. At this time, the center of the polisher 15 is at an axis Y' offset by $e_2$ from the Y axis, and this Y' axis moves at a radius $e_2$ about the axis Y. At this time, the axial rotation shaft 13 is present at the center of the orbital rotation transmission shaft 11, but the rotation transmitter 4 rotates about the first coupling pin 3 with the same phase as the revolution of the revolution transmission axis 11 because of the rotation transmitter 4 being located with the same deviation $e_1$ as the deviation of the Y axis and the Y' axis. The axial rotation of the orbital rotation transmission shaft 11 is therefore not limited regardless of whether the first axial rotation transmitter 2 stops or rotates.

On the other hand, with regards to rotational movement, the first axial rotation transmitter 2 is rotated by the rotation motor 1. However, the first coupling pin 3 is concentric with the first axial rotation transmitter 2, and passes through the same locus about the Y-axis. The axis of rotation of the axial rotation shaft 13 is offset from the axis of rotation of the first axial rotation transmitter 2 by $e_2$, and the same number of rotations as for the first axial rotation transmitter 2 are transmitted to the axial rotation shaft 13 with the second coupling pin 5 concentric with the second axial rotation transmitter 6 maintaining an offset of $e_1$.

A polishing member (not shown) is provided at the polisher 15 at the upper end of the axial rotation shaft 13 and rod-shaped members 16 of ferrules etc. to be polished by the end surface of the polishing member come into contact with the polishing member. The rod-shaped members 16 are detachably fixed to multiple fixing jigs 17 and the polisher 15 is pushed with a prescribed force by a pressing shaft 19. The fixing jigs 17 are prevented from rotating by a rotation prevention pin 20. A plurality of weights (not shown) are also arranged in such a manner that an arbitrary value can be selected for a weight to be applied to the support mechanism.

However, with the aforementioned related machine, there have been problems with regards to reducing the amount of space taken up by the machine, improving energy consumption, and improving ease of assembly because separate drive units are provided for axial rotation and for orbital rotation.

Further, the drive units have different torques for axial and orbital rotation. Therefore, when the plurality of rod-shaped members 16 fixed to the fixing jigs 17 are pushed when performing polishing, the rotation of the orbital rotation motor is uneven, the polishing locus becomes disturbed, and the desired polishing cannot be achieved.

In order to resolve the aforementioned problems, the present invention sets out to provide an end surface polishing drive mechanism and an end surface polishing machine that has a smaller footprint, consumes less energy, is easier to assemble, and in which work precision is improved without disturbing g the polishing locus.

SUMMARY OF THE INVENTION

In order to resolve the aforementioned problems the present invention provides, in a first aspect of the present invention, an end surface polishing drive mechanism for reciprocally rotating a polisher having a polishing member, pressing a rod-shaped member supported at a fixing jig onto the polishing member of the polisher and polishing the rod-shaped member. The drive mechanism comprises a rotating shaft, an orbital rotation shaft, orbital rotation shaft support means, drive means, a first gear, and a second gear. The rotating shaft has one end fixed to the polisher, and rotates both axially and orbitally together with the polisher.

The orbital rotation shaft freely rotates at a position offset from the rotating shaft. The orbital rotation shaft support means supports the orbital rotation shaft in a freely rotating manner. The drive means rotatably drives the orbital rotation shaft. The first gear is fixed to, or close to, the other end of the rotating shaft. The second gear is provided along the locus of movement of the first gear and meshes with the first gear. Here, the rotating shaft rotates in conjunction with rotation of the orbital rotation shaft due to the drive means, and the rotating shaft rotates due to meshing of the first gear and the second gear.

In a second embodiment of the present invention, in addition to the first embodiment, the second gear is rotatably driven by the drive means at a different speed to the orbital rotation shaft.

In a third embodiment of the present invention, in addition to the first and second embodiments, the drive force of the drive means is transmitted to the orbital rotation shaft via a timing belt or a train of gears.

In another aspect, the present invention is directed to an end surface polishing machine having the end surface polishing drive mechanism according to the present invention.

According to the end surface polishing drive mechanism and the end surface polishing of the present invention, axial and orbital rotation can be performed by a single drive means and the machine therefore has a smaller footprint, consumes less power and is easier to assemble, while the load placed on the drive means does not change for rotating and revolving.

BRIEF DESCRIPTION OF THE DRAWINGS

FIGS. 4A–4D are views illustrating loci of rotation;

DETAILED DESCRIPTION OF THE PREFERRED EMBODIMENTS

The following is a detailed description, based on the drawings, of the embodiments of the present invention.

Figure 1:
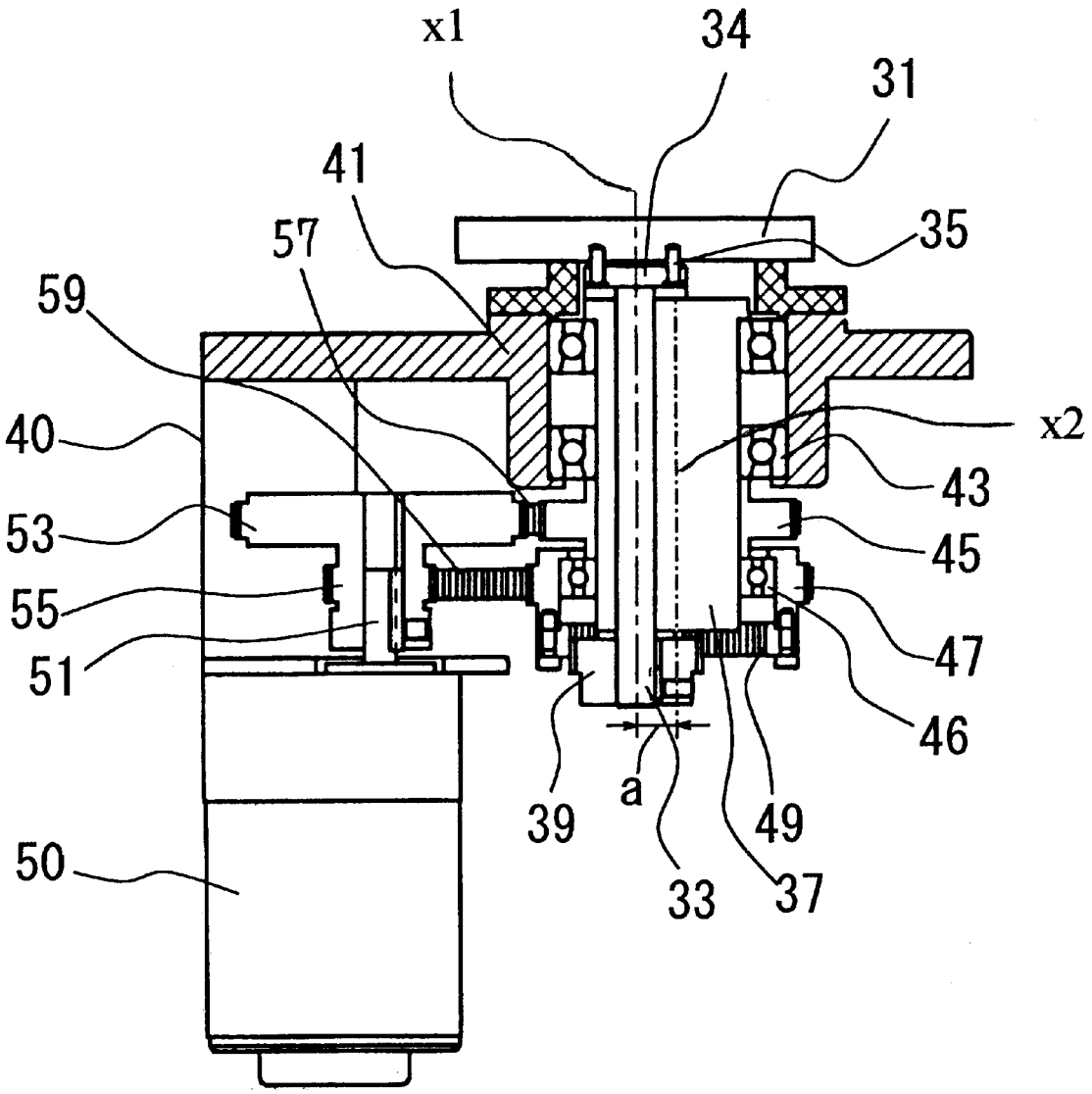
FIG. 1 is a cross-sectional view of a drive mechanism of an end surface polishing machine according to the present invention.

FIG. 1 shows a cross-section of the essential parts of a drive mechanism for an end surface polishing machine of a first embodiment of the present invention.

As shown in FIG. 1 the lower surface of a polishing surface plate 31 and a flange 34 at an upper end of a first rotation shaft 33 hereinafter "rotation shaft" are coupled via a plurality of coupling pins 35, and the polishing surface plate 31 is supported by the rotation shaft 33. This rotation shaft 33 is supported for undergoing rotation about an axis X1 at a position offset by a prescribed amount a from central rotational axis X2 of a second rotational shaft 37 (hereinafter "orbital rotation shaft") and a rotating gear 39 is fixed to the lower end of the rotation shaft 33 that passes through the orbital rotation shaft 37.

The orbital rotation shaft 37 is rotatably supported at a support 41 of a machine body 40 via a bearing 43. An orbital rotation gear 45 is fixed at the center of the orbital rotation shaft 37. A rotation regulation gear 47 that freely rotates via a bearing 46 is provided at the lower end of a orbital rotation gear 45 of the orbital rotation shaft 37 and an inner gear 49 that engages; with the rotating gear 39 is fixed to the lower end of the rotation regulation gear 47.

A motor 50 constituting a drive means is mounted on the machine body 40. An orbital rotation pulley 53 and an axial rotation pulley 55 are provided at a motor shaft 51 of the motor 50. The orbital rotation pulley 53 and the orbital rotation gear 45 are coupled by a timing belt 57, and the axial rotation pulley 55 and the rotation regulation gear 47 are coupled by a timing belt 59.

A description is now given of the operation of the above drive mechanism.

Figure 2:
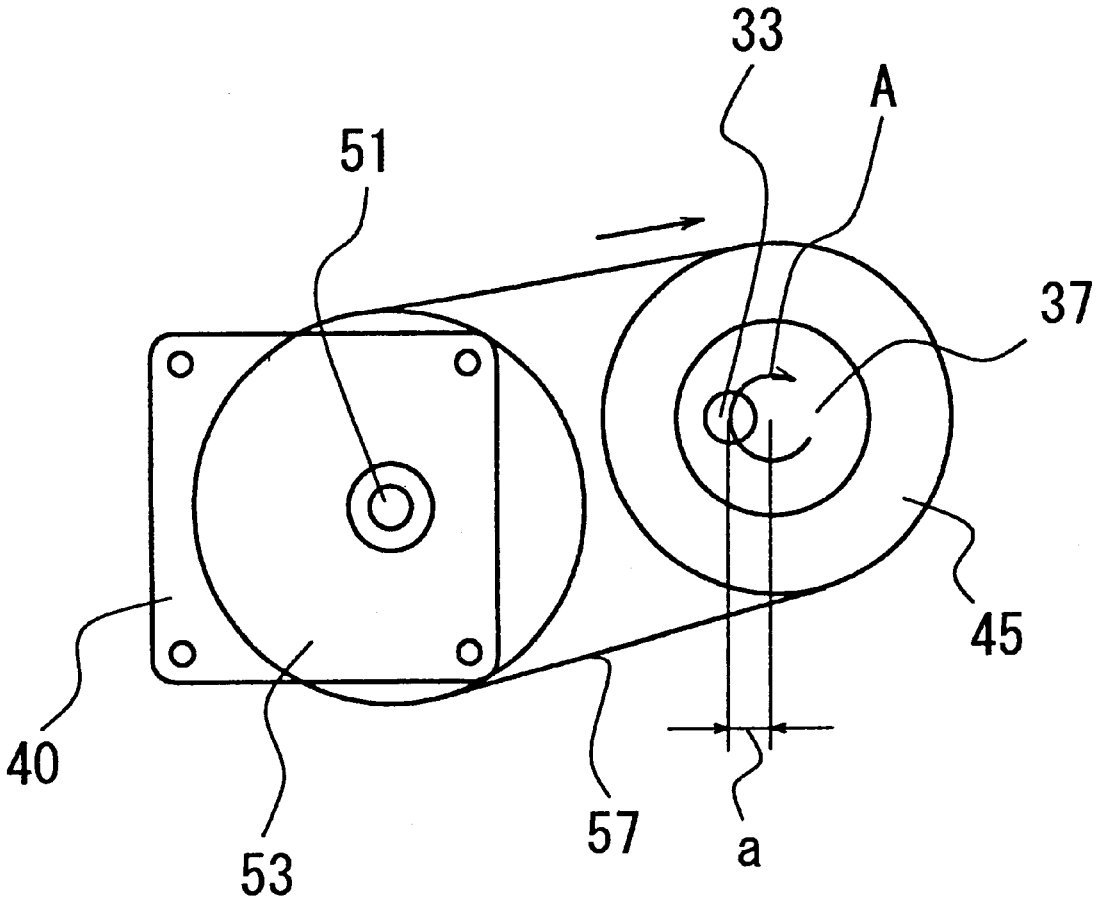
FIG. 2 is a view illustrating orbital rotation.

FIG. 2 is a view illustrating orbital rotation. As shown in FIG. 2, when the orbital rotation pulley 53 is rotated via the motor shaft 51, the orbital rotation shaft 37 is rotatably driven via the timing belt 57 and the orbital rotation gear 45. At this time, the rotation shaft 33 supported in a freely rotatable manner at a position offset from the axis of the orbital rotation shaft 37 revolves along an arrow A at a radius a about the axis of the orbital rotation shaft 37.

Figure 3:
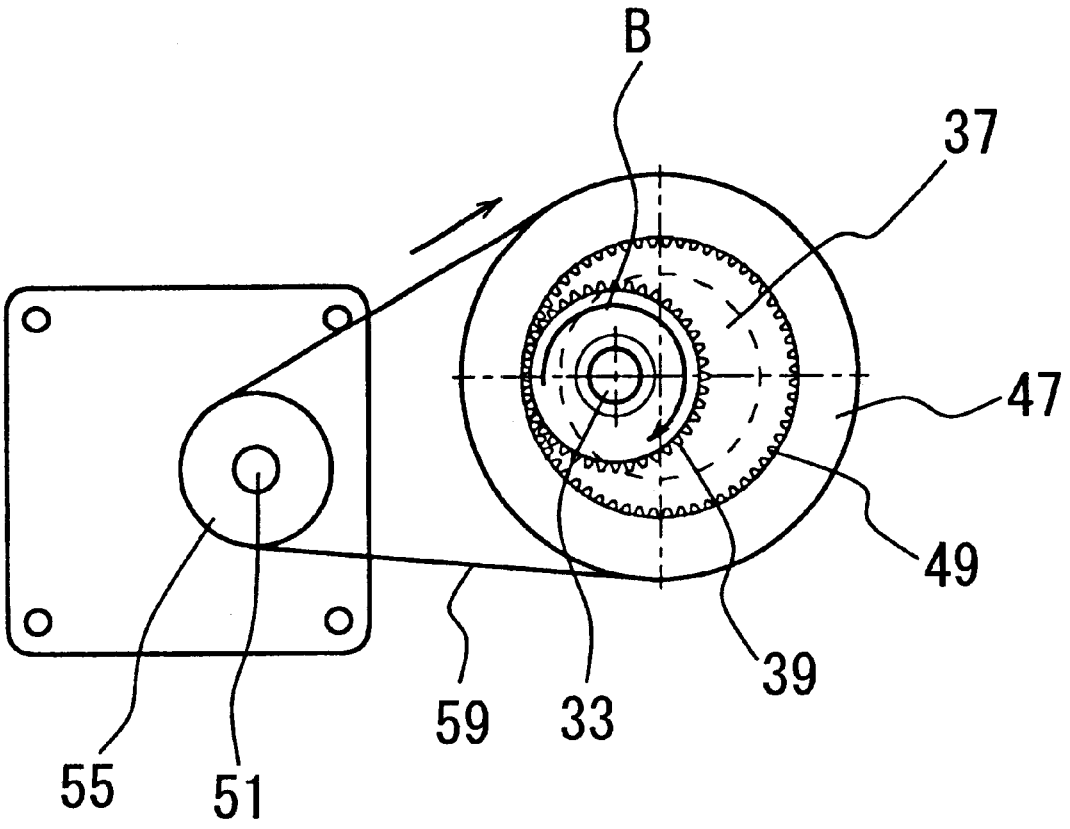
FIG. 3 is a view illustrating axial rotation.

On the other hand, FIG. 3 is a view illustrating axial rotation. When the axial rotation pulley 55 is rotated by the motor shaft 51, the inner gear 49 is rotated by the timing belt 59 and the rotation regulation gear 47. The rotation shaft 33 turns in the aforementioned manner, and therefore rotates by just the difference between the amount of rotation due to the meshing of the rotating gear 39 and the inner gear 49 due to revolving and the amount of rotation transmitted to the rotating gear 39 due to rotation of the inner gear 49. In this case, the rotation shaft 33 rotates in the direction of the arrow B because the number of rotations of the inner gear 49 is large.

The locus of the rod-shaped members pushed onto the polishing surface plate 31 is shown in FIGS. 4A–4D. The locus due to the revolving of the rotation shaft 33 in response to the rotation of the orbital rotation shaft 37 is a circular locus 61 of radius a, as shown in FIG. 4A. When the locus due to the rotation of the rotation shaft 33 is then overlapped with this locus, the circular locus becomes a continuous donut-shaped locus 62, as shown in FIG. 4B.

In this embodiment, the locus 62 is, without exception, decided by the gear ratio of the orbital rotation pulley 53 and the axial rotation pulley 55 and by the gear ratio of the inner gear 49 and the rotating gear 39. The locus itself will therefore not become disordered as shown, for example, in FIG. 4C even if a load is put on the motor 50 so that the revolution speeds falls.

Figure 5:
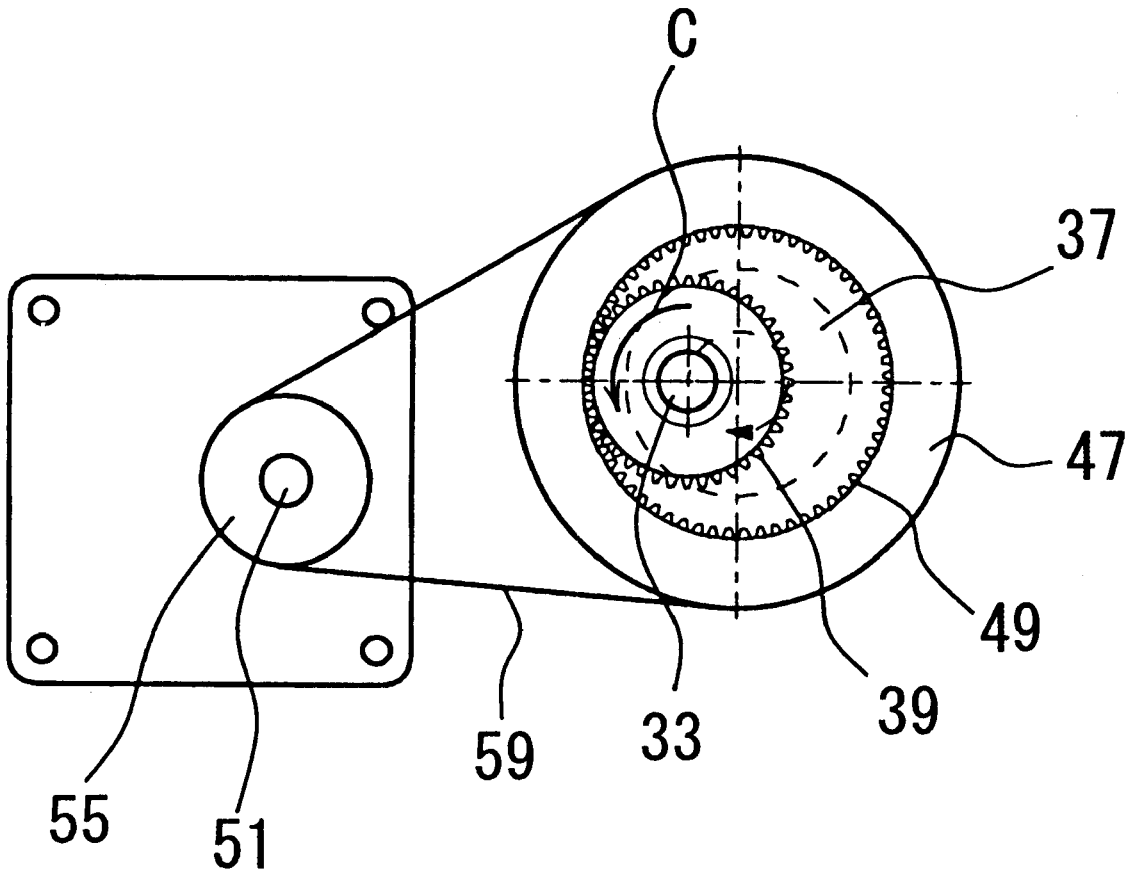
FIG. 5 is a view illustrating axial rotation when an inner gear does not rotate.
Figure 6:
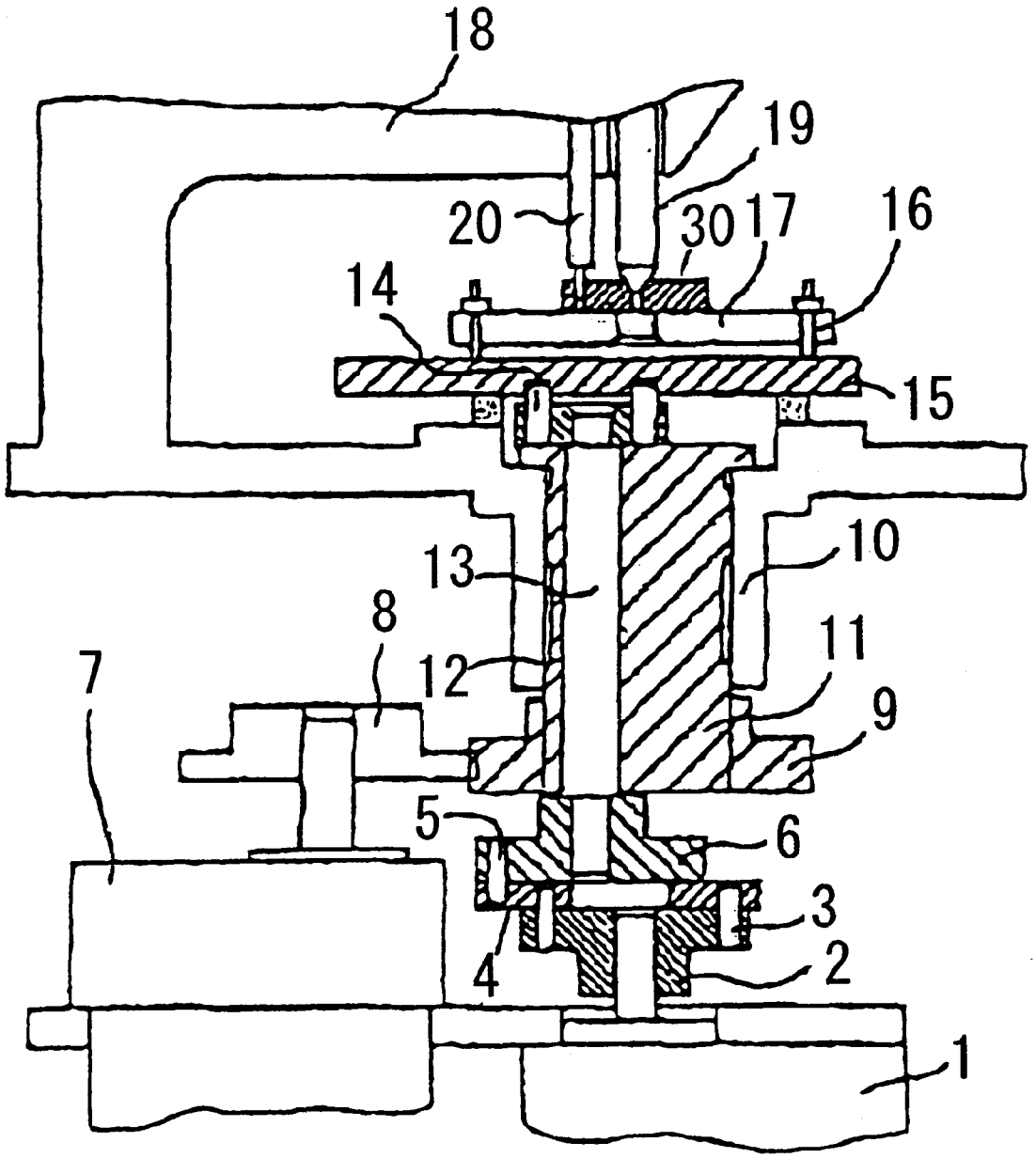
FIG. 6 Prior Art
FIG. 6 is a cross-sectional view showing an example of an end surface polishing machine of the prior art.
Figure 7:
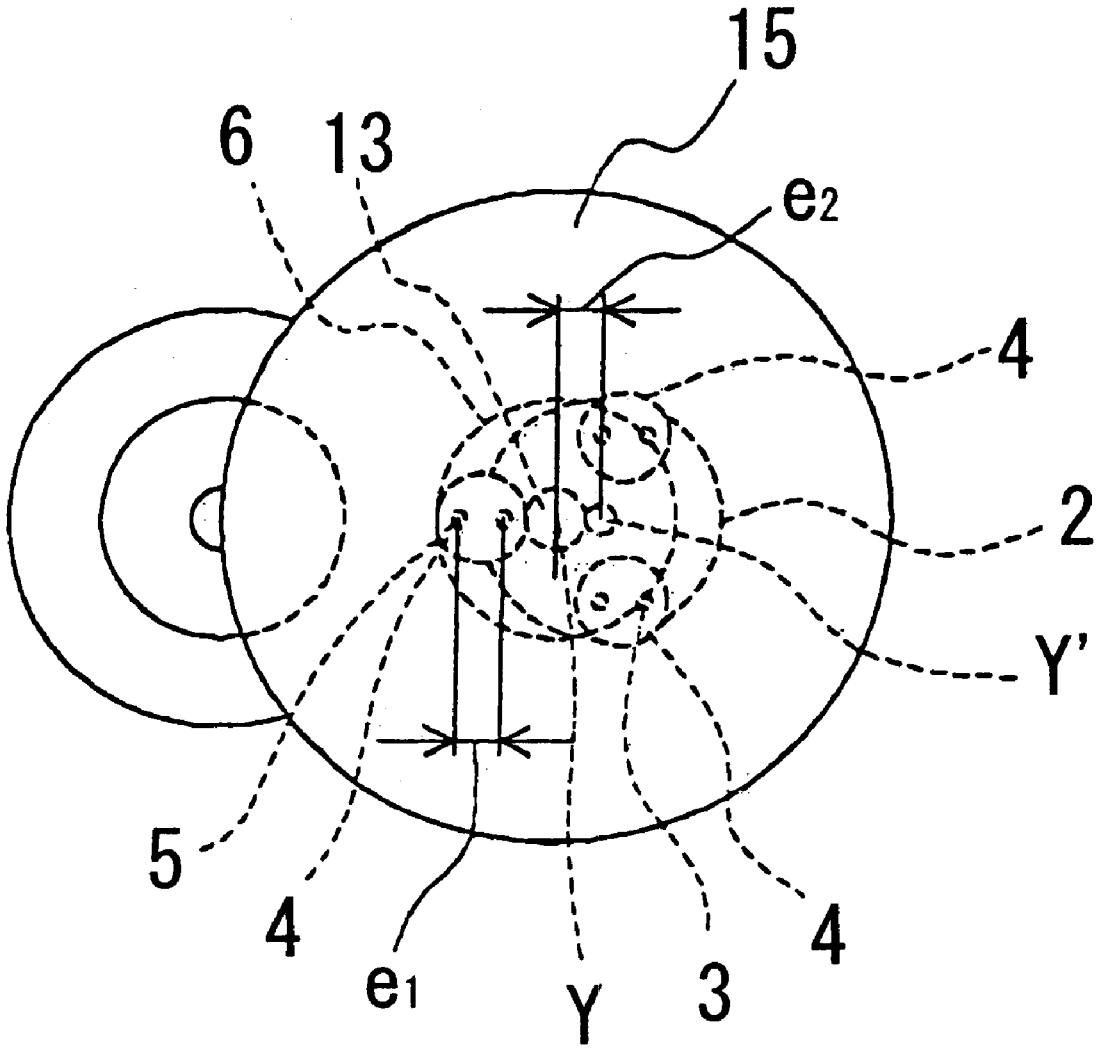
FIG. 7 Prior Art
FIG. 7 is a view illustrating orbital and axial rotation of the prior art.

It is not always necessary for the inner gear 49 to be rotatably. That is, when the inner gear 49 does not rotate, or rotates relatively slowly, as shown in FIG. 5, the rotating gear 39 is rotated in the direction of an arrow C in the direction opposite to the aforementioned example due to meshing with the inner gear 49 while the rotating gear 39 revolves due to the revolving of the rotation shaft 33. The locus in this case is as show in FIG. 4D because of the relationship of the gear ratio and does not become a circular locus. This locus can, however, be made suitable for polishing by changing the gear ratio.

The preferred embodiment of an end surface polishing machine of the present invention is described above, but the present invention is by no means limited to the particular features described above the invention is applicable to any machine for polishing end surfaces of rod-shaped members while rotating and revolving.

Further, timing belts are used as the drive transmission mechanism but a gear mechanism or normal V-type belt can also be employed in place of the timing belts.

According to the drive mechanism of the present invention, the end surf ace polishing machine has a smaller footprint, consumes less power, is easier to assemble, and operates with greater work precision without the polishing locus becoming disordered.

What is claimed is:

1. An end surface polishing drive mechanism comprising:

a first rotational shaft mounted for undergoing rotation about a first axis and for undergoing revolving movement about a second axis offset from the first axis, the first rotational shaft having a first end for connection to a polishing member during use of the end surface polishing drive mechanism to rotate and revolve the polishing member about the first and second axes, respectively;

a second rotational shaft for undergoing rotation about the second axis;

support means for supporting the second rotational shaft to undergo free rotation about the second axis;

drive means for rotationally driving the first rotational shaft and the second rotational shaft;

a first gear connected to a second end of the first rotational shaft opposite the first end thereof;

a second gear comprised of a second regulation gear rotatably mounted on the second rotational shaft for meshing engagement with and disposed along a locus of movement of the first gear to transmit a drive force of the drive means to the first rotational shaft;

a jig board for supporting at least one workpiece having an end face; and a movable support mechanism for supporting the jig board and for moving the jig board to bring the end face of the workpiece into pressure contact with the polishing member to thereby polish the end face of the workpiece during rotation and revolving movement of the first rotational shaft.

2. An end surface polishing drive mechanism according to claim 1; wherein the drive means includes means for driving the second gear at a speed different from a driving speed of the second shaft.

3. An end surface polishing drive mechanism according to claim 1; further comprising a timing belt for transmitting a drive force of the drive means to the second shaft.

4. An end surface polishing drive mechanism according to claim 1; wherein the drive means includes means for driving the second gear at a speed different from a driving speed of the second shaft; and further comprising a timing belt for transmitting a drive force of the drive means to the second shaft.

5. An end surface polishing drive mechanism according to claim 1; further comprising a train of gears for transmitting a drive force of the drive means to the second shaft.

6. An end surface polishing drive mechanism according to claim 1; wherein the drive means includes means for driving the second gear at a speed different from a driving speed of the second shaft; and further comprising a train of gears for transmitting a drive force of the drive means to the second shaft.

7. An end surface polishing drive mechanism comprising:

a first rotational shaft mounted for undergoing rotation about a first axis and for undergoing revolving movement about a second axis, the first rotational shaft having a first end for connection to a polishing device during use of the end surface polishing drive mechanism to undergo rotation therewith and a second end;

a second rotational shaft for undergoing rotation about the second axis;

drive means for producing a driving force to rotationally drive the first and second rotational shafts and to revolve the first rotational shaft;

first transmission means for transmitting the driving force of the driving means to rotate and revolve the first rotational shaft, the first transmission means comprising a first gear connected to the second end of the first rotational shaft, a second gear comprised of a rotation regulation gear rotatably mounted on the second rotational shaft for meshing engagement with and disposed along a locus of movement of the first gear, and means for transmitting the driving force of the driving means to the first and second gears to thereby rotationally drive the first rotational shaft about the first axis;

second transmission means for transmitting the driving force of the driving means to rotate the second rotational shaft while the first shaft undergoes rotation and revolving movement;

a jig board for supporting at least one workpiece having an end face; and a movable support mechanism for supporting the jig board and for moving the jig board to bring the end face of the workpiece into pressure contact with the polishing device to thereby polish the end face of the workpiece during rotation and revolving movement of the first rotational shaft.

8. An end surface polishing drive mechanism comprising:

a first rotational shaft mounted for undergoing rotation about a first axis and for undergoing revolving movement about a second axis, the first rotational shaft having a first end for connection to a polishing device to undergo rotation therewith and a second end;

a second rotational shaft for undergoing rotation about the second axis;

drive means for producing a driving force to rotationally drive the first and second rotational shafts and to revolve the first rotational shaft;

a first gear connected to the first rotational shaft for undergoing rotation and revolving movement therewith; and a second gear rotatably mounted on the second rotational shaft and connected to the first gear for transmitting a drive force of the drive means to the first rotational shaft.

9. An end surface polishing drive mechanism according to claim 7; wherein the means for transmitting comprises a timing belt.

10. An end surface polishing drive mechanism according to claim 7; wherein the timing belt comprises a v-type belt.

11. An end surface polishing drive mechanism according to claim 7; wherein the means for transmitting comprises a gear train for transmitting the driving force of the drive means to the first and second gears to thereby rotationally drive the first shaft about the first axis.

12. An end surface polishing drive mechanism according to claim 7; wherein the second transmission means comprises a transmission belt for transmitting the driving force of the drive means to the second shaft to thereby rotate the second shaft and revolve the first shaft about the second axis.

13. An end surface polishing drive mechanism according to claim 12; wherein the transmission belt comprises a timing belt.

14. An end surface polishing drive mechanism according to claim 12; wherein the transmission belt comprises a V-type belt.

15. An end surface polishing drive mechanism according to claim 7; wherein the second transmission means comprises a train of gears for transmitting the driving force of the drive means to the second shaft to thereby rotate the second shaft and revolve the first shaft about the second axis.

16. An end surface polishing drive mechanism according to claim 7; wherein the means for transmitting comprises a gear train for transmitting the driving force of the drive means to the first and second gears to thereby rotationally drive the first shaft about the first axis; and wherein the drive means includes means for driving the second gear of the first transmission means at a speed different from a driving speed of the second shaft.

17. An end surface polishing drive mechanism according to claim 16; wherein the second transmission means comprises a transmission belt for transmitting the driving force of the drive means to the second shaft to thereby rotate the second shaft and revolve the first shaft about the second axis.

18. An end surface polishing drive mechanism according to claim 17; wherein the transmission belt comprises a timing belt.

19. An end surface polishing drive mechanism according to claim 17; wherein the transmission belt comprises a V-type belt.

20. An end surface polishing drive mechanism according to claim 16; wherein the second transmission means comprises a train of gears for transmitting the driving force of the drive means to the second shaft to thereby rotate the second shaft and revolve the first shaft about the second axis.

21. An end surface polishing machine comprising:

a first rotational shaft mounted for undergoing rotation about a first axis and for undergoing revolving movement about a second axis, the first rotational shaft having a first end and a second end;

a second rotational shaft for undergoing rotation about the second axis;

drive means for producing a driving force to rotationally drive the first and second rotational shafts and to revolve the first rotational shaft;

first transmission means for transmitting the driving force of the drive means to rotate and revolve the first rotational shaft;

second transmission means for transmitting the driving force of the drive means to rotate the second rotational shaft while the first rotational shaft undergoes rotation and revolving movement;

a polishing plate connectable to a polishing member during use of the end surface polishing machine and connected to the first end of the first rotational shaft for undergoing rotation and revolving movement therewith to rotate and revolve the polishing member;

a jig board for supporting at least one workpiece having an end face; and a movable support mechanism for supporting the jig board and for moving the jig board to bring the end face of the workpiece into pressure contact with the polishing member to thereby polish the end face of the workpiece during rotation and revolving movement of the first rotational shaft.

22. An end surface polishing machine according to claim 21; wherein the first transmission means comprises a first gear connected to the second end of the first shaft, a second gear for meshing engagement with and disposed along a locus of movement of the first gear, and a transmission belt for transmitting the driving farce of the drive means to the first and second gears to thereby rotationally drive the first shaft about the first axis.

23. An end surface polishing m machine according to claim 22; wherein the transmission belt comprises a timing belt.

24. An end surface polishing machine according to claim 22; wherein the transmission belt comprises a V-type belt.

25. An end surface polishing machine according to claim 21; wherein the first transmission means comprises a first gear connected to the second end of the first shaft, a second gear for meshing engagement with and disposed along a locus of movement of the first gear, and a gear train for transmitting the driving force of the drive means to the first and second gears to thereby rotationally drive the first shaft about the first axis.

26. An end surface polishing machine according to claim 21; wherein the second transmission means comprises a transmission belt for transmitting the driving force of the drive means to the second shaft to thereby rotate the second shaft and revolve the first shaft about the second axis.

27. An end surface polishing machine according to claim 26; wherein the transmission belt comprises a timing belt.

28. A n end surface polishing machine according to claim 26; wherein the transmission belt comprises a V-type belt.

29. An end surface polishing machine according to claim 21; wherein the second transmission means comprises a train of gears for transmitting the driving force of the drive means to the second shaft to thereby rotate the second shaft and revolve the first shaft about the second axis.

30. An end surface polishing machine according to claim 21; wherein the first transmission means comprises a first gear connected to the second end of the first shaft, a second gear for meshing engagement with and disposed along a locus of movement of the first gear, and a gear train for transmitting the driving force of the drive means to the first and second gears to thereby rotationally drive the first shaft about the first axis; and wherein the driving means includes means for driving the second gear of the first transmission means at a speed different from a driving speed of the second shaft.

31. An end surface polishing machine according to claim 30; wherein the second transmission means comprises a transmission belt for transmitting the driving force of the drive means to the second shaft to thereby rotate the second shaft and revolve the first shaft about the second axis.

32. An end surface polishing machine according to claim 31; wherein the transmission belt comprises a timing belt.

33. An end surface polishing machine according to claim 31; wherein the transmission belt comprises a V-type belt.

34. An end surface polishing machine according to claim 30; wherein the second transmission means comprises a train of gears for transmitting the driving force of the drive means to the second shaft to thereby rotate the second shaft and revolve the first shaft about the second axis.

35. An end surface polishing drive mechanism comprising:

a first rotational shaft mounted for undergoing rotation about a first axis and for undergoing revolving movement about a second axis offset from the first axis, the first rotational shaft having a first end for connection to a polisher to rotate and revolve the polisher about the first and second axes, respectively;

a second rotational shaft for undergoing rotation about the second axis;

support means for supporting the second rotational shaft to undergo free rotation about the second axis;

drive means for rotationally driving the first rotational shaft and the second rotational shaft;

a first gear connected to a second end of the first rotational shaft opposite the first end thereof;

a second gear disposed along a locus of movement of the first gear and meshing with the first gear for transmitting a drive force of the drive means to the first rotational shaft;

a first pulley connected to the second gear for transmitting the drive force of the drive means to the second gear; and a second pulley for transmitting the drive force of the drive means to the second rotational shaft.

36. An end surface polishing drive mechanism according to claim 35; wherein the first pulley and the second pulley are formed in one piece.

37. An end surface polishing drive mechanism comprising:

a first rotational shaft mounted for undergoing rotation about a first axis and for undergoing revolving movement about a second axis offset from the first axis, the first rotational shaft having a first end for connection to a polishing member to rotate and revolve the polishing member about the first and second axes, respectively;

a second rotational shaft for undergoing rotation about the second axis;

support means for supporting the second rotational shaft to undergo free rotation about the second axis;

drive means for rotationally driving the first rotational shaft and the second rotational shaft;

a first gear connected to a second end of the first rotational shaft opposite the first end thereof; and a second gear rotatably mounted on the second rotational shaft and disposed along a locus of movement of the first gear, the second gear meshing with the first gear for transmitting a drive force of the drive means to the first rotational shaft.

* * * * *